United States Patent [19]

Granger

[11] Patent Number: 4,621,755

[45] Date of Patent: Nov. 11, 1986

[54] DEVICE FOR DISPENSING AND SIMULTANEOUSLY CUTTING ROLLED UP MATERIALS IN WEBS

[76] Inventor: Maurice Granger, 17 rue Marcel Pagnol, 42270 Saint Priest en Jarez, France

[21] Appl. No.: 711,805

[22] Filed: Mar. 14, 1985

[30] Foreign Application Priority Data

Mar. 21, 1984 [FR] France ..... 84 04695

[51] Int. Cl.[4] ..... B26F 3/02; A47K 10/36

[52] U.S. Cl. ..... 225/96; 83/334; 225/106

[58] Field of Search ..... 83/334, 335; 225/96, 225/106

[56] References Cited

U.S. PATENT DOCUMENTS

| | | | |
|---|---|---|---|
| 4,188,844 | 2/1980 | DeLuca | 83/835 X |
| 4,206,858 | 6/1980 | DeLuca | 83/334 X |
| 4,276,797 | 7/1981 | Baummann et al. | 83/334 X |

*Primary Examiner*—James M. Meister
*Attorney, Agent, or Firm*—Eric P. Schellin

[57] ABSTRACT

The object of the invention relates to the technical branch of dispensing means for lengths of materials rolled up on reels. The device is remarkable because the pinked cutting hinged device (4) elastically returned into the drum (3) is connected through a roller (18) or a similar free-running component to a part (16) assuming the shape of a cam (16*b*), the double profile (16*c*–16*e*) of which is designed so as to allow, in addition to the projection of the blade (4*a*) outside the drum for the purpose of cutting the material pulled manually, spinning the drum after the cut without any slamming of the blade holder, and in order to facilitate the braking, stopping and repositioning functions of the drum for a new cut, in cooperation with shock-protecting or buffing devices (19), stops (22–23–24), and ratchet (21) suitably associated, arranged on the drum and shock protector. The invention relates to dispensers of paper, cotton wool and similar wiping materials.

5 Claims, 7 Drawing Figures

Fig. 1
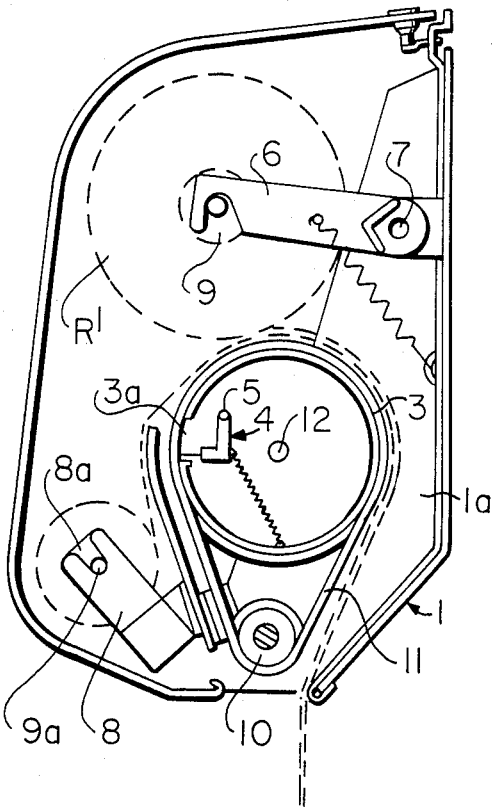
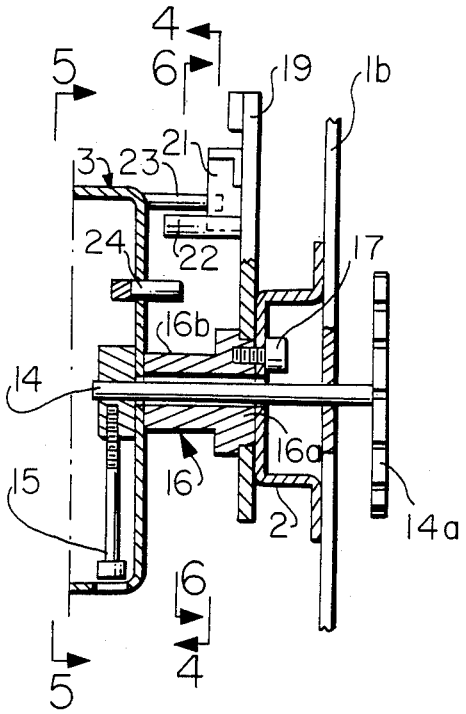
Fig. 3
Fig. 2
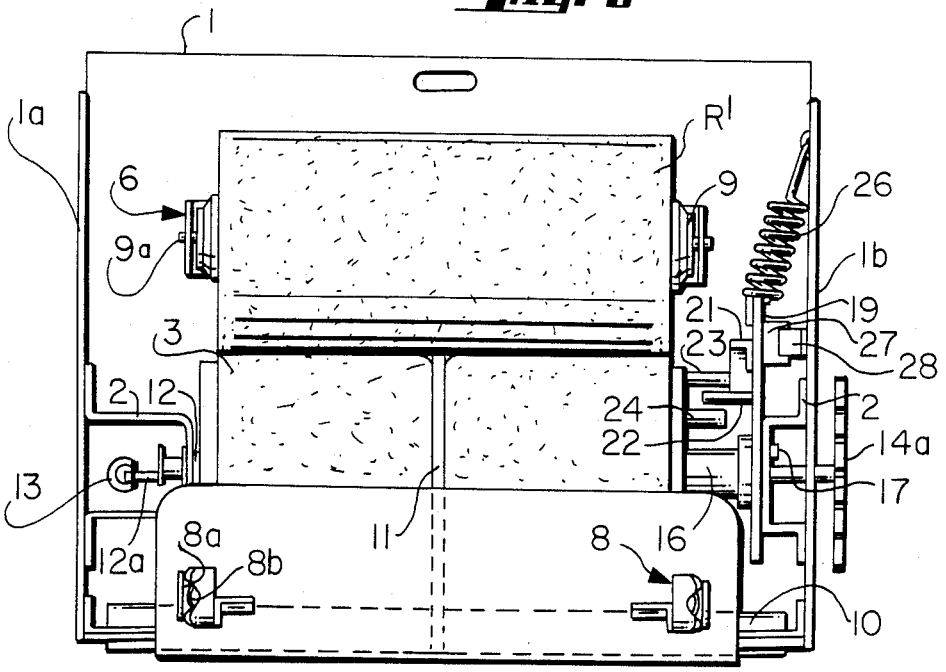

Fig. 4
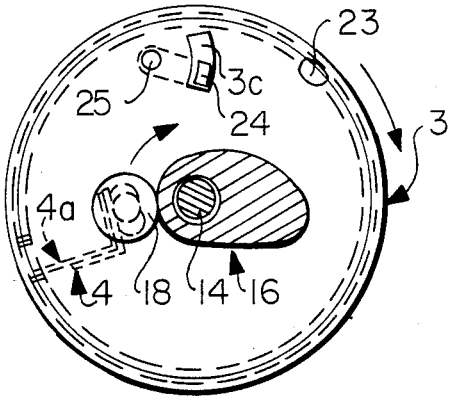
Fig. 6
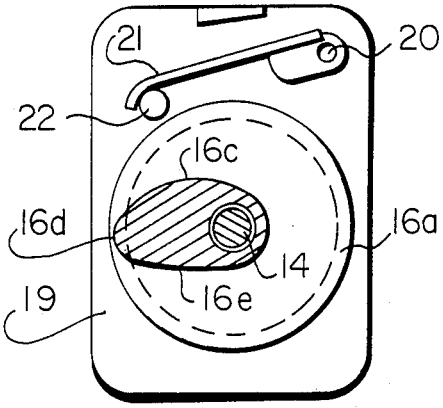
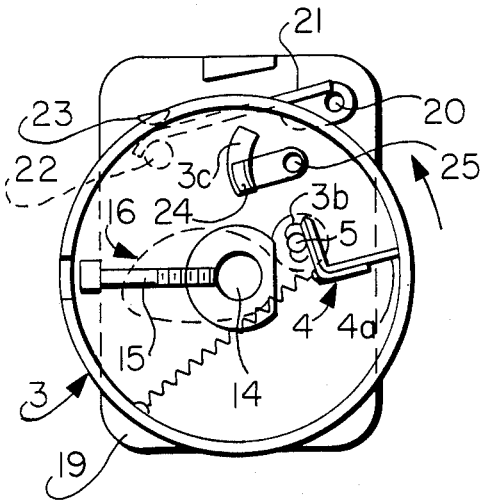
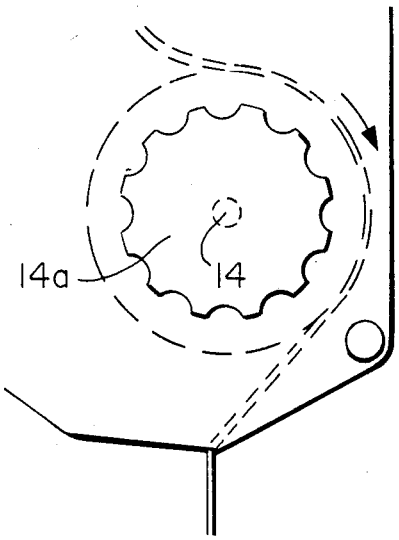
Fig. 5
Fig. 7

DEVICE FOR DISPENSING AND SIMULTANEOUSLY CUTTING ROLLED UP MATERIALS IN WEBS

BACKGROUND OF THE INVENTION

1. Field of the Invention

This invention relates to a device for dispensing and simultaneously cutting rolled up materials in webs.

The object of the invention relates to the technical branch of dispensing means for lengths of materials rolled up on reels. More particularly, but not exclusively, the invention relates to dispensers of paper, cotton wool and similar wiping materials.

2. Description of the Prior Art

The device is of the type in which a roll of material is freely rotating on a support and is applied with pressure directly on to a drum with non-sliding surface so that by a simple manual pull on the web of material that projects from the device, a web is automatically dispensed and cut. The length of cut material is very nearly equal to the drum diameter. It is cut by means of a pinked cutting device associated with the drum and projecting from the drum when it is rotated by pulling the material, so as to penetrate into the material taut on either side of the cutting mechanism. After the cut, the spinning drum rotates back to its original position through the action of various additional components, and a new web of material will project from the device.

SUMMARY

According to this invention, we wish to improve the operation of this type of device for which several patents or additional written statements were filed, of which the applicant is also the patent owner.

According to a first feature, the pinked cutting hinged device is elastically returned into the drum is connected through a roller or a similar free-running component to a fixed cam. The double profile of the cam is designed to allow, in addition to the projection of the blade outside for cutting the material pulled manually, spinning of the drum after the cut without any slamming of the blade holder, and in order to facilitate the braking, stopping and repositioning functions of the drum for a new cut. The cam in cooperation with shock-protecting or buffing devices, stops, ratchet suitably associated, arranged on the drum and shock protector.

Another feature is the fact that the drum is directly connected to a component acting at the same time as drum rotating shaft and drum rotating means accessible either from the outside of the wall fixing plate or from the outside of the device casing.

Other specific objects and advantages will appear as the specification proceeds.

In order to clarify the object of the invention, however without limiting it, the invention is illustrated by the accompanying drawings, in which:

FIG. 1 is a section which illustrates as an example only a dispensing and cutting device likely to take the characteristic arrangements according to the invention.

FIG. 2 is a front view with casing removed of the device according to the invention.

FIG. 3 is a partial section on larger scale which illustrates the various components forming the object of the invention.

FIGS. 4, 5 and 6 are sections taken on the lines 4—4, 5—5 and 6—6 of FIG. 3, showing components according to the invention.

FIG. 7 is a partial view illustrating the manual drive of the drum according to an embodiment.

DETAILED DESCRIPTION

In order to concretize the object of the invention, it is now described as a non limitative embodiment as illustrated in the accompanying drawings.

The device is comprised of a wall fixing base plate (1) with a supporting means (2) for the free-rotation of a drum (3) having an inside blade-holder (4) hinged at (5) on a drum side wall. The blade holder is suitably connected to means which form the object of the invention so as to allow the periodic outside movement of a pinked cutting blade (**4*a*) outside of the drum, when the web of material projecting from the lower part of the device is pulled, thereby rotating the drum with a rough surface on which is applied the roll (R1) of material held in a supporting stirrup (6) hinged at (7**) on the base plate.

One can see that the device is fitted with a deflector plate extending in front of the drum and supporting fixed or takedown sloping support arms (8) made from a resilient material in order to take after spreading in slots (**8*a*) trunnions (9*a*) formed on flanges (9) which are enged in the core of the roll. Thus, when the roll of material is almost empty, it can be placed with its trunnions in the openings (8*b*) formed at the base of the slots, and a new roll can be placed on its supporting stirrup (6**). In this way, two webs of material can be simultaneously dispensed, until the first roll is empty.

A roll (10) freely rotating between the side plates of the base plate (1) is also illustrated, extending parallely to the drum immediately above the opening for the material to run through, under the device. In its central part, the roll (10) is rotationally connected to the drum through a belt (11) or a similar component, in order to guide the material towards the opening, thereby preventing it to pass between said drum and said roll, as well as for preventing introduction of fingers into the device close to the cutting blade.

The drum rotates freely on supporting means (2) which is integral with side plates (**1*a*–1*b*) of the base plate. On the one end, the drum wall is integral with a shaft (12) extended by an eccentric pin (12*a*) connected to the side plate (1*a*) through a spring (13). On the opposite end, the drum is connected to the bracket (2) through a shaft (14) retained by a set screw (15) and crossing the side plate (1*b*), fitted with a handwheel (14*a*) or another similar operating means fixed on the projecting shaft end. Between the bracket (2) and the drum, a part (16) is inserted having a face resting against the support (2) where it is fixed by at least one screw (17). On the opposite end, the part (16) assumes the shape of a cam (16*b*), the profile of which is apparent in FIGS. 4, 5 and 6, i.e. with a curved top part (16*c*) designed so as to move the cutting blade (4*a*) out of the drum through a follower (18) mounted on the end of said blade and crossing the drum wall through an appropriate slot (3*b*). After the rounded off part (16*d*) on the most eccentric end, the cam assumes an inside profile (16*e*) which is also curved, however less marked in order to carry out on the one end the blade withdrawal and on the other end the drum spinning after cut without slam or ungentleness, in cooperation with the eccentric (12*a*) return spring (13**) which is suitably orientated in order to ensure its function of forced storage just after the cut.

Between the cam (16*b*) and the support face, the part (16) is fitted with a centering pin with shoulder (16*a*) to take a free-rotating shock protector (19) which is thus only retained between the part (16) and the bracket (2). On this shock protector a ratchet pawl (21) pivots on one end (20) and rests by gravity on a stop pin (22) integral with the shock protector.

Besides, the drum wall is fitted with a projecting finger (23) close to its periphery, integral with the said wall. Closer to the center of the drum, a projecting stop (24) hinged at (25) on the inside of the drum which it crosses through a curved slot (3*c*), in the drum wall.

Let us describe now the operating principle of the device and more particularly the above-mentioned components, with reference to the accompanying drawings, in FIGS. 4, 5 and 6.

At rest, when a web of material projects below the device, ready to be pulled, the finger (23) rests on the end of ratchet pawl (21) which in its turn is applied by gravity on to stop (22) of the shock protector (FIG. 5), and the moving stop (24) is also in bottom position in the slot (3*c*) due to its own weight.

When the projecting web of material is pulled, the drum (3) is rotated due to its rough surface, and the follower (18) rolls on the top profile (16*c*) of the cam in order to move the blade out when the opening (3*a*) of the drum has passed beyond the roll of material (R1). The pinked cutting blade then penetrates into the material taut on either side, thereby turning with the drum until the material is completely torn off.

The drum relieved from the pull of the material continues turning by the action of the spring (13) taut by the eccentric, and the return spring of the blade holder compels the follower (18) to follow the lower profile (16*e*) of the cam, thus securing the withdrawal of the blade. During rotation, the finger (28) freely passes between the stop (22) and the ratchet pawl (21) lifting it. The moving stop (24), through the action of the centrifugal force, is forced outwardly to the top position of up the slot (3*c*) and contacts the stop (22) of the shock protector in order to stop the rotation of the drum after a limited tipping movement of the shock protector with respect to a spring (26). Spring 26 is connected to the side plate (1*b*) of the base plate (FIG. 2).

As spring (26) of the shock protector pulls it back, the moving stop (24) moves down to the low position and the finger (23) is again pressed against the ratchet pawl (21) which has fallen freely on to the shock protector stop (22), which is then stopped in its swinging movement due to the force of the finger (23), and by a stop (27) integral with the shock protector and urged against a stop (28) integral with the side plate (1*b*), as shown in FIG. 2. The device is then ready to be used again, since through the additional rotation of the drum after the cut, a new web of material has projected below the device.

The advantages will be apparent from the description, but the following features are more particularly underlined:

Simplification of the components involved in the operation of the device with respect to the mechanisms used in the previous applications of the applicant, thus securing a high reliability and an exonomical production.

The double profile of the blade-holder cam allows progressive outward movement of the blade out of the drum with a minimum of force required and its backward movement also in a gentle manner, which facilitates the ratchet engagement, i.e. the correct positioning of the drum for a new dispensing.

the efficient operation of various drive mechanisms, which prevent unrolling of several lengths of materials at one and the same time, and formation of loops of material between the roll and the drum during operation; possible tearing can be eliminated by manual operation of the drum through external operation means.

Easy assembly of components, without any specific adjustment.

The invention is in no way limited to the type of application of embodiments discussed herein; but it is to be understood that many variations and modifications will readily occur to those skilled in the art and are intended to be included within the scope of the invention.

I claim:

1. Device for the simultaneous dispensing and cutting of bands of wound materials, having at least one roll of material (R1) which is mounted so that it can rotate freely on a support means and is applied with pressure directly onto a drum (3) with a non-slip surface so that a sheet of predetermined length is automatically dispensed and cut by simple manual tension on the band of material extending from the device, the cutting is performed by an indented cutting device (4) associated with the drum (3) and which extends outside of the drum during a cutting operation which is activated by putting the drum in rotation by pulling on the material, during the cutting operation the cutting device penetrates into the material stretched across the drum on both sides of the cutting device, whereby the cutting device is articulated so that is can elastically return into the drum after the cut, when the drum is rotated back to its initial position a new band of material extends from the device, characterized in that the cutting device is connected by a roller (18) to a cam (16) which is fixed to the support means (2) the cam is constructed on a side of the support means (2) and can receive and guide with free and limited rotation a shock protecting means (19) having a catch means (20–21) and a stop pin means (22), the drum (3) is provided with a side facing the shock protecting means (19) and with stops (23–24) which cooperate with the catch means and the stop pin means (20, 21, 22) of the shock protecting means (19) permitting the starting of the drum after the cut without banging of the blade carrier and facilitates braking and repositioning the drum after a new cut.

2. Device according to claim 1, characterized in that the cam (16) comprises a support face against the support means (2) where is fixed thereto by at least one screw (17), and a shoulded centered bearing (16*a*) for the free but transversally limited rotation of the shock protecting means (19) which is angularly retained by a spring (26) that is coupled to the support means.

3. Device according to claim 1, characterized in that the catch (21) at one end of the shock protecting means and which rests by gravity at its other end on the stop pin means (22) which is integral with the shock protecting means in order to keep the drum (3) in rotation in one direction, by means of a projecting finger stop (23) projecting from the drum wall which strikes against the catch.

4. Device according to claim 1, characterized in that the wall of the drum (3) facing the shock protecting means comprises an articulated stop (24) coupled to the inside of the drum and having an extending part traversing this wall by an orifice in the shape of an arc of a circle (3*c*), that the articulation (25) of the articulated stop is located so that it is naturally in low position in the orifice when at rest, and that due to the action of the centrifugal force generated during the rotation of the drum, this stop is forced outwardly in the orifice so that the extending part rests against the stop pin means of the shock protecting means when the drum is to be stopped after the cutting transferring rotational force to the shock protecting means.

5. Device according to claim 1, wherein the drum (3) is mounted so that it can rotate freely on support means (2) which is integral with cheeks (1*a*–1*b*) of a baseplate attached to a wall, on one side of the drum an eccentric axle (12–12*a*) is provided, which is connected to a spring (13) for starting the drum after the cut, characterized in that on the other side of the drum another axle (14) successively traverses the cam, the support means (2), and one of the cheek (1*b*), and that this axle comprises an operating means (14*a*) in order to permit a manual drive of the drum in case the material tears off in the device.

* * * * *